US009506364B2

(12) United States Patent
Tanaka et al.

(10) Patent No.: US 9,506,364 B2
(45) Date of Patent: Nov. 29, 2016

(54) SEALING ARRANGEMENT AND GAS TURBINE ENGINE WITH THE SEALING ARRANGEMENT

(75) Inventors: Ryozo Tanaka, Kakogawa (JP); Tomoki Taniguchi, Kobe (JP)

(73) Assignee: Kawasaki Jukogyo Kabushiki Kaisha, Hyogo (JP)

( * ) Notice: Subject to any disclaimer, the term of this patent is extended or adjusted under 35 U.S.C. 154(b) by 823 days.

(21) Appl. No.: 13/521,635

(22) PCT Filed: Jan. 11, 2011

(86) PCT No.: PCT/JP2011/050279

§ 371 (c)(1),
(2), (4) Date: Jul. 11, 2012

(87) PCT Pub. No.: WO2011/086993

PCT Pub. Date: Jul. 21, 2011

(65) Prior Publication Data

US 2012/0294706 A1 Nov. 22, 2012

(30) Foreign Application Priority Data

Jan. 12, 2010 (JP) ..... 2010-003657

(51) Int. Cl.
*F01D 11/00* (2006.01)

(52) U.S. Cl.
CPC ..... *F01D 11/005* (2013.01); *F01D 11/003* (2013.01); *F05D 2220/3212* (2013.01); *F05D 2230/642* (2013.01); *F05D 2240/12* (2013.01); *F05D 2250/131* (2013.01); *F05D 2250/75* (2013.01)

(58) Field of Classification Search
CPC ..... F01D 11/005; F01D 11/003; F05D 2250/75; F05D 2250/131; F05D 2220/3212; F05D 2230/642; F05D 2240/12; F16J 9/16; F16J 9/20
USPC ..... 277/491
See application file for complete search history.

(56) References Cited

U.S. PATENT DOCUMENTS 4,183,396 A * 1/1980 Kinast et al. ..... 165/9
4,318,668 A * 3/1982 Chaplin et al. ..... 415/135
5,253,877 A * 10/1993 DeBiasse et al. ..... 277/437

(Continued)

FOREIGN PATENT DOCUMENTS

DE 698 25 961 T2 9/2005
DE 602 13 946 T2 9/2007

(Continued)

OTHER PUBLICATIONS

English translation of the International Preliminary Report on Patentability and the Written Opinion of the International Searching Authority dated Aug. 16, 2012; International Application No. PCT/JP2011/050279.

(Continued)

*Primary Examiner* — Ninh H Nguyen
*Assistant Examiner* — Aaron R Eastman
(74) *Attorney, Agent, or Firm* — Studebaker & Brackett PC

(57) ABSTRACT

At least one sealing arrangement is provided for a connecting mechanism between an inner annular member or an outer annular member and an associated segment to connect between the annular members and the segments. The sealing arrangement includes an elastic sealing member provided between the sealing surfaces, disposed linearly along a side of polygon defined around a central axis.

4 Claims, 5 Drawing Sheets

(56) References Cited

U.S. PATENT DOCUMENTS

| | | | | |
|---|---|---|---|---|
| 5,676,521 | A * | 10/1997 | Haynes | 415/169.1 |
| 5,915,697 | A * | 6/1999 | Bagepalli et al. | 277/627 |
| 6,164,908 | A | 12/2000 | Nishida et al. | |
| 7,090,224 | B2 * | 8/2006 | Iguchi et al. | 277/603 |
| 2003/0012643 | A1 * | 1/2003 | Tiemann | 415/170.1 |
| 2003/0021676 | A1 * | 1/2003 | Tiemann | 415/134 |
| 2003/0122310 | A1 | 7/2003 | Mohammed-Fakir et al. | |
| 2003/0123980 | A1 | 7/2003 | Mohammed-Fakir et al. | |
| 2004/0031271 | A1 * | 2/2004 | Jorgensen | 60/796 |
| 2006/0123797 | A1 * | 6/2006 | Zborovsky et al. | 60/800 |
| 2008/0202124 | A1 * | 8/2008 | Sutcu et al. | 60/796 |
| 2008/0267768 | A1 * | 10/2008 | Dakowski et al. | 415/115 |

FOREIGN PATENT DOCUMENTS

| | | | |
|---|---|---|---|
| EP | 1 323 896 | A2 | 7/2003 |
| EP | 0 921 278 | B1 | 9/2004 |
| JP | A-10-339108 | | 12/1998 |
| JP | A-2003-222032 | | 8/2003 |
| JP | A-2003-227354 | | 8/2003 |
| JP | A-2004-316509 | | 11/2004 |
| WO | WO 98/55737 | | 12/1998 |

OTHER PUBLICATIONS

Apr. 5, 2011 International Search Report issued in International Patent Application No. PCT/JP2011/050279.

* cited by examiner

SEALING ARRANGEMENT AND GAS TURBINE ENGINE WITH THE SEALING ARRANGEMENT

TECHNICAL FIELD

The present invention relates to a sealing arrangement. The present invention also relates to a sealing arrangement preferably incorporated within a gas turbine engine. The present invention further relates to a sealing arrangement for sealing between a turbine nozzle and its neighborhood member or members in the gas turbine engine.

BACKGROUND OF THE INVENTION

In the gas turbine, a compressor compresses air. The compressed air is supplied to combustors where it is combusted with fuel to generate high-temperature combustion gas. The generated combustion gas is supplied to a turbine where its energy is converted into a rotation power of a rotor. Accordingly, a leakage of the compressed air is needed to be avoided or minimized in order to effectively extract the rotation power in the gas turbine engine.

Practically, however, there exist gaps at connections between radially-inward and radially-outward annular members, e.g., between the turbine nozzle and annular members supporting the nozzle in the gas turbine engine, through which a part of the compressed air for cooling generated at the compressor may leak into a downstream section such as turbine. An increase of the leakage will result in a decrease in performance of the gas turbine engine.

JP 10-339108 discloses a sealing technique in which a rib is provided on a downstream flange surface of the stationary blade to make a linear sealing contact between a sealing surface of the rib and a stationary blade support ring to prevent the leakage of the compressed air. According to this technique, the seal can be maintained and, as a result, the leakage of the compressed air can be prevented, even where the stationary support ring inclines to its neighborhood member or members.

Disadvantageously, the structural members of the gas turbine engine are exposed to a high-temperature during its operation, which may vary relative positions or distances between the structural members in the radial and/or axial direction and, as a result, gaps between the neighborhood elements which may not be accommodated by the conventional sealing technique to result in the leakage of the compressed air.

Therefore, an object of the invention is to provide a sealing arrangement and a gas turbine engine incorporating the sealing arrangement, by which a seal is maintained in a stable manner even when the relative angles and/or positions between the structural members of the gas turbine engine were changed due to their thermal expansion or contraction and, as a result, the performance and the reliability of the gas turbine engine are increased.

SUMMARY OF THE INVENTION

To attain the object, an aspect of the sealing arrangement according to the embodiment of the invention is used in a mechanism. The mechanism comprises an inner annular member having a central axis and an outer annular member surrounding around the inner annular member; a plurality of segments disposed between the inner and outer annular members and peripherally around the central axis; an inner connecting mechanism connecting between the segment and the inner annular member; and an outer connecting mechanism connecting between the segment and the outer annular member. The inner connecting mechanism and/or the outer connecting mechanism has the sealing arrangement. The sealing arrangement comprises a first seal surface formed on the associated segment; a second seal surface formed on the annular member connected to the associated segment by the connecting mechanism; and an elastic seal member held between the first and second seal surfaces and extended linearly along a side of a polygon defined around the central axis.

In another aspect of the invention, the elastic sealing member is made of a strip-like metal plate, the metal plate being curved around a longitudinal axis so that one end and the other end of a cross-section of the elastic member are spaced away from each other to define an opening therebetween.

In another aspect of the invention, the elastic sealing member is positioned between a high-pressure zone and a low-pressure zone so that the opening is exposed to the high pressure zone.

In another aspect of the invention, the sealing arrangement in any one of claims 1-3, wherein the first seal surface or the second seal surface has a groove extending along the side of the polygon defined around the central axis and the elastic sealing member is disposed in the groove.

In another aspect of the invention, the elastic sealing member is compressively fitted in the groove.

In another aspect of the invention, the groove has a square cross-section and the elastic sealing member has a J-like configuration with a linear portion and a curved portion extending from a distal end of the linear portion. Also, the elastic sealing member is positioned in the groove so that a proximal end of the linear portion and an intermediate region of the curved portion are forced on an inner surface of the groove.

The invention further is directed to a gas turbine engine with the sealing arrangement, in which the inner annular member is an inner casing or an adaptor ring supported by the inner annular member; the outer annular member is an outer casing; and the segments are nozzle segments connecting between combustors and a turbine.

According to the sealing arrangement of the invention, even when an inclination or displacement is occurred between the member due to heat expansion or contraction, a reliable and stable seal is maintained between the members, which results in that the gas turbine engine with the sealing arrangement is capable of effectively using the compressed air generated by the compressor.

PARTS LIST

C: central axis

21: inner casing (inner annular member)

26: turbine casing (outer annular member)
35: nozzle segment
42: outer connecting mechanism
57: adaptor ring (inner annular member)
110: inner connecting mechanism
123: upstream end surface of flange (first sealing surface)
131: downstream end surface of front wall (second sealing surface)
151: upstream end surface of back wall (second sealing surface)
153: elastic sealing member

PREFERRED EMBODIMENT OF THE INVENTION

With reference to the accompanying drawings, a gas turbine engine and a sealing arrangement incorporated therein will be described below. Like reference numbers denote like or similar parts throughout the specification.

Figure 1:
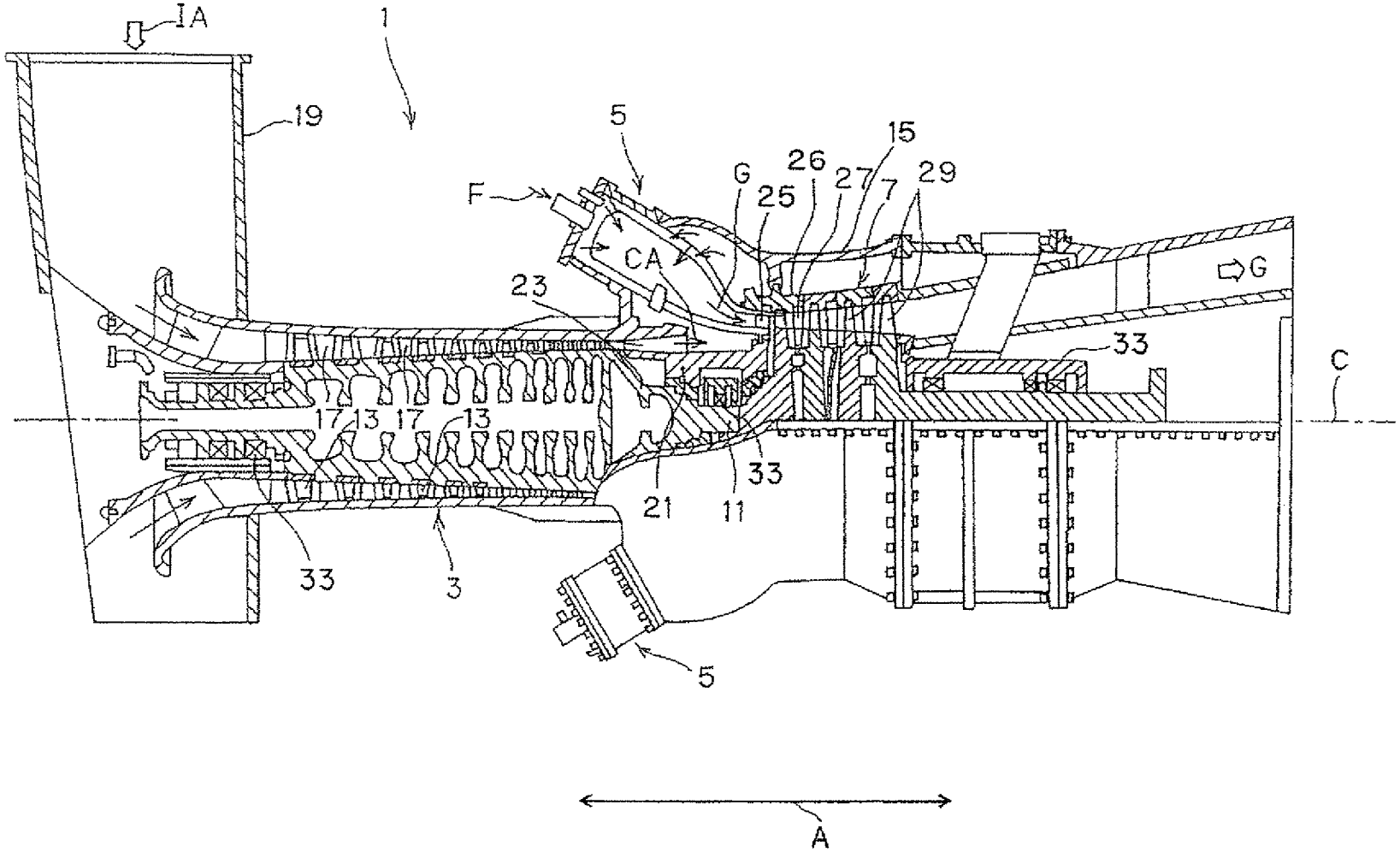
FIG. 1 is a partially broken away side elevational view of a gas turbine engine with the sealing arrangement according to an embodiment of the invention.

Referring to FIG. 1, the gas turbine engine (hereinafter referred to as "engine") according to an embodiment of the invention, which is generally indicated by reference number 1, comprises, similar to the conventional engine, a compressor 3 for compressing intake air IA, a plurality of combustors for mixing the compressed air with fuel F and combusting the mixture of the air and the fuel, and a turbine 7 for using the high-temperature and high-pressure combustion gas G generated in the combustors 5 to generate a rotational power. In the following descriptions, left and right sides of the engine indicated in FIG. 1 are referred to as "upstream" or "upstream side" and "downstream" or "downstream side", respectively.

In the embodiment, the compressor 3 is an axial-flow compressor and comprises a plurality stages of moving blades 13 securely mounted on an upstream outer peripheral surface of the rotor 11 supported for rotation about a longitudinal axis C by upstream and downstream bearings 33 and a plurality stages of stationary blades 17 securely mounted on an inner peripheral surface of a housing 15 surrounding the rotor 11, the moving and stationary blades 13 and 17 being arranged alternately in the axial direction so that the intake air IA from the intake cylinder 19 is compressed by the cooperation of the moving and stationary blades 13 an 17.

An inner casing (inner annular member) 21 is provided between the compressor 3 and the turbine 7 so as to surround and rotatably support an intermediate portion of the rotor 11. Also provided between the inner casing 21 and the housing 15 are a plurality of passages or diffusers 23 through which the compressed air CA is fed from the compressor 3 into respective combustors 5 and a turbine nozzle 25 (including the first stage stationary blade) through which the high-temperature and high-pressure combustion gas G are fed from the respective combustors 5 into the turbine 7.

The turbine 7 is provided inside the housing 15 and comprises a turbine casing (outer casing, outer annular member) 26 surrounding the downstream portion of the rotor 11. The inner peripheral surface of the turbine casing 26 has a plurality stages of turbine stationary blades 27 securely mounted thereon. Correspondingly, the outer peripheral surface of the rotor 11 has a plurality stages of turbine moving blades 29 securely mounted thereon so that the stationary and moving blades 27 and 29 are positioned alternately in the axial direction, which allows that the combustion gas G ejected from the combustors 5 are guided by the turbine stationary blades 27 and also effectively impinged on the turbine moving blades 29 to cause a rotational force of the rotor 11.

Figure 2:
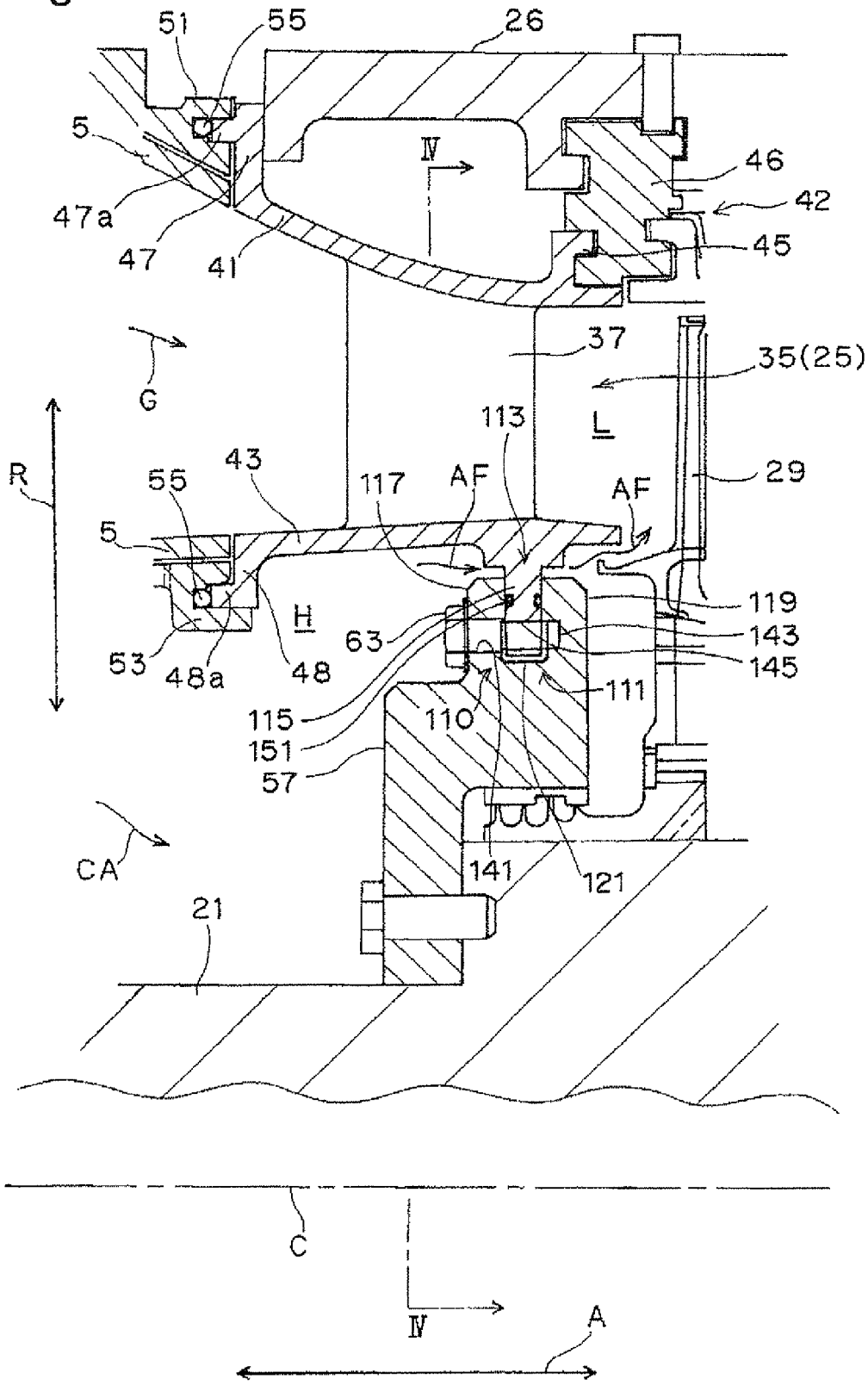
FIG. 2 is a cross sectional view showing structures of a turbine nozzle and neighborhood arrangements of the gas turbine engine shown in FIG. 1.
Figure 4:
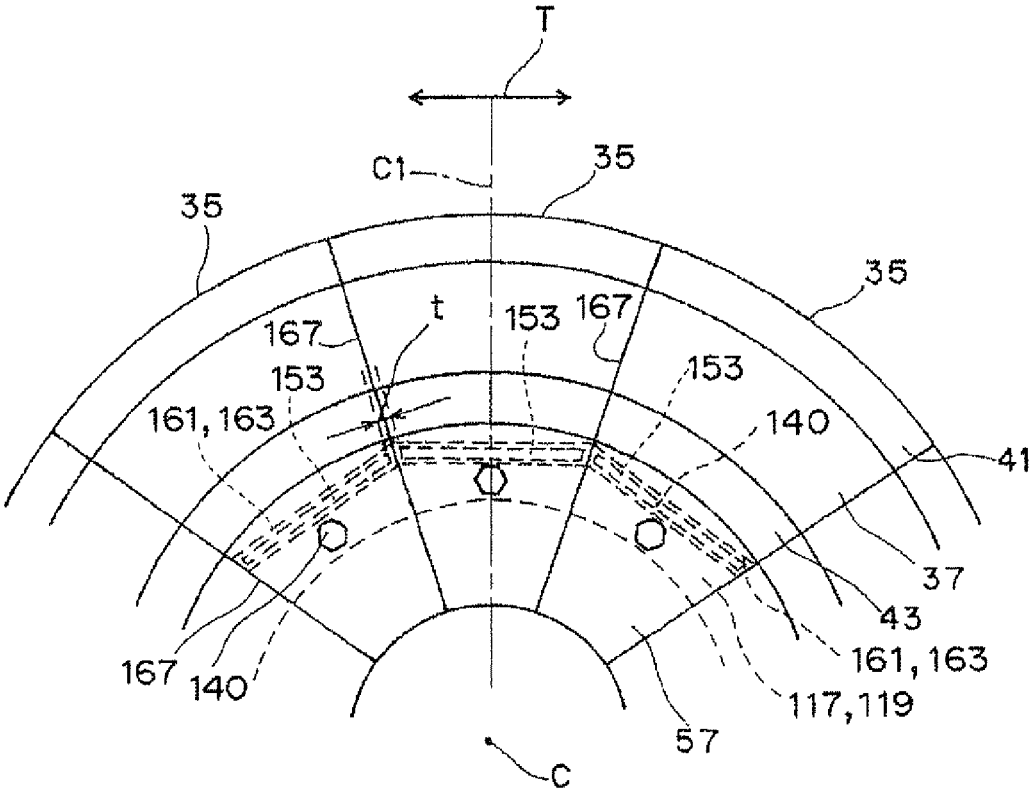
FIG. 4 is a cross sectional view taken along lines IV-IV in FIG. 2.

FIG. 2 shows the turbine nozzle 25 of the engine 1 in FIG. 1 and its peripherals in a large scale. The turbine nozzle 25 has, as shown in FIG. 4, a plurality of sectors or nozzle segments 35 arranged continuously in the peripheral direction around the axis C. In the embodiment, the turbine nozzle 25 is made of ten nozzle segments 35.

Referring back to FIG. 2, each nozzle segment 35 comprises a first-stage turbine stationary blade 37 and inner and outer peripheral wall portions 43 and 41 provided on radially outer and inner sides of the turbine stationary blade 37, respectively, and formed integrally with the turbine stationary blade 37.

The outer peripheral wall portion 41 is connected to the turbine casing 26 through an outer connecting mechanism 42. The outer connecting mechanism 42 has a support flange 45 extending radially outwardly from the downstream outer peripheral surface of the outer peripheral wall 41 and a connecting member 46 connecting between the support flange 45 and the turbine casing 26.

The outer peripheral wall 41 and the inner peripheral wall 43 have an outer connecting flange 47 and an inner connecting flange 48 integrally formed therewith at upstream ends thereof and extending radially outwardly and inwardly therefrom, respectively. The outer connecting flange 47 and the inner connecting flange 48 have engaging portions **47*a* and 48*a* extending upwardly, respectively. As shown in the drawing, the engaging portions 47*a* and 48*a* are fitted in engaging grooves 51 and 53, respectively, formed at the downstream ends of the transition duct together with sealing members 55, which results in that the upstream ends of the turbine nozzle 25 are connected to the combustors 5. A sealing member which is commercially available from Nippon Valqua Industries, Ltd., under the trade name "Cord Seal", is preferably used for the sealing member 55**.

As shown in FIGS. 2 and 4, an annular adaptor ring 57 is secured by bolts on the periphery of the inner casing 21 for supporting the radially inner ends of the nozzle segments 35. Each of the nozzle segments 35 is connected through an inner connecting mechanism 110 to the annular adaptor ring (inner annular member) 57.

The inner connecting mechanism 110 has an annular inner connector 111 mounted on an outer peripheral surface of the adaptor ring 57 and an annular outer connector 113 mounted on an inner peripheral surface of the inner peripheral wall 43 of the nozzle segment 35.

Figure 3:
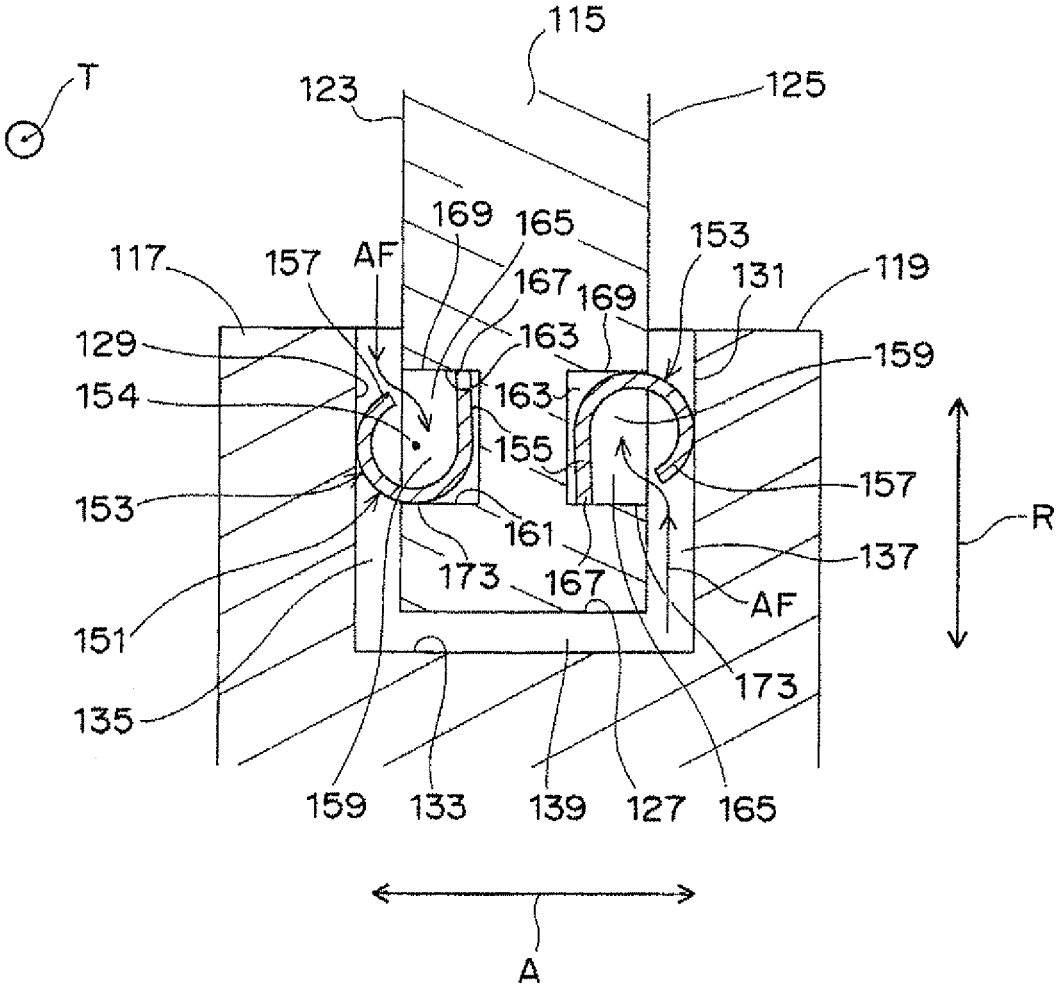
FIG. 3 is a cross sectional view of the sealing arrangement according to the invention.

In the embodiment, the outer connector 113 has a peripheral flange 115 extending radially inwardly from the inner peripheral wall 43. The inner connector 111 has annular front wall 117 and back wall 119, opposed to and spaced way from each other in the axial direction indicated by arrow A to define an annular groove 121 between the front wall 117 and the back wall 119. As shown in FIG. 3, the connectors 111 and 113 are shaped and sized so that the peripheral flange 115 is positioned within the groove 121 and, in this condition, the upstream and downstream end surfaces 123 and 125 and the inner peripheral end surface 127 of the peripheral flange 115 oppose the downstream end surface 129 of the front wall 117, the upstream end surface 131 of the back wall 119, and the bottom wall 133 connecting the end surfaces 129 and 131, leaving suitable gaps 135, 137 and 139, respectively.

As shown in FIG. 4, each of the nozzle segments 35 is connected to the adaptor ring 57 through bolt connector 140. As shown in FIG. 2, in the embodiment the bolt connector 140 has a through-hole 141 extending through the front wall 117 and a threaded-hole 143 positioned coaxially with the through-hole 141 and formed in the upstream end surface of the back wall 119. Each nozzle segment 35 has a through-hole 145 corresponding to the bolt connector. Then, each nozzle segment 35 is connected to and supported by the adaptor ring 57 by positioning the peripheral flange 115 within the groove 121, aligning the bolt 147 with the through holes 141 and 145, and threading the bolt 147 in the threaded hole 143.

In FIG. 2, the annular space defined and surrounded by the inner peripheral wall 43 is a high pressure zone H in which the high-pressure compressed air CA generated by the compressor 3 enters. A space from the turbine nozzle (the first stage stationary blade) 25 to the moving blade (the first moving blade) 29 positioned on the downstream side of the turbine nozzle 25 is a low pressure zone L where the gas exhausted from the combustors 5 is expanded and then the pressure therein is lower than the high pressure zone H. Therefore, if no sealing members were provided in the gaps 133-139 between the outer and inner connectors 111 and 113, the high- and low-pressure zones H and L would be communicated with each other through the gaps, allowing the compressed air to leak from the high-pressure zone H to the low-pressure zone L as indicated by arrow AF. To avoid the leakage of the compressed air, the inner connecting mechanism 110 has a sealing arrangement 151 for sealing the gaps between the connectors 111 and 113.

As shown in FIG. 3, the sealing arrangement 151 according to the embodiment comprises sealing members 153 provided between the upstream and downstream end surfaces (sealing surfaces) 123 and 125 and the downstream and the downstream end surface (sealing surface) 129 of the front wall 117 and the upstream end surface (sealing surface) 131 of the back wall 119 opposing the surfaces 123, 125, respectively. The sealing member 153, which is formed by bending an elastic strip or plate about an axis 154 extending in a longitudinal direction to have a J-like cross-section, has a linear portion 155 and a curved portion 157 extending from one end of the linear portion 155 along a circle with a certain diameter and about 180 to about 300 degrees, to form a dead-end cavity surrounded by the linear portion 155 and the curved portion 157. The elastic sealing member 153 is preferably made of a metal plate having certain elasticity, heat-resistance, and mechanical strength. One of the preferable metals is nickel base alloy.

In the embodiment, in order to hold the elastic sealing member 153 in a stable manner, as shown in FIG. 4 the upstream and downstream end surfaces 123 and 125 of the peripheral flange 115 of each nozzle segment 135 have square-shaped grooves 161 and 163, respectively, extending linearly in a direction indicated by arrow T along each side of the regular decagon defined with its center positioned on the central axis C. Also, as shown in FIG. 3, the elastic sealing member 153 is compressively fitted in the grooves 161 and 163 with the linear portions 155 thereof positioned adjacent the bottoms of the grooves 161 and 163, with the curved portions 157 positioned adjacent the openings of the grooves 161 and 163, respectively, and with the openings 165 of the dead-end cavities 159 exposed to the high-pressure zone H. Specifically, regarding the sealing member 153 indicated on the left side of FIG. 3, the proximal end 167 of the linear portion 155 is elastically abutted against the radially outer surface 169 of the groove 161, the intermediate portion of the curved portion 157 is elastically abutted against the radially inner surface 173 of the groove 161, and another intermediate portion closer to the distal end of the curved portion 157 is elastically abutted against the downstream end surface 129 of the front wall, forming respective seals between the sealing members and the associated abutting surfaces. Likewise, regarding the sealing member 153 indicated on the right side of FIG. 3, the proximal end 167 of the linear portion 155 is elastically abutted against the radially inner surface 173 of the groove 163, the intermediate portion of the curved portion 157 is elastically abutted against the radially outer surface 169 of the groove 161, another intermediate portion closer to the distal end of the curved portion 157 is elastically abutted against the downstream end surface 129 of the front wall, forming respective seals between the sealing members and the associated abutting surfaces.

Referring again to FIG. 4, the grooves 161 and 163 are extended up to the radial end surfaces 167 of the nozzle segment 35, so that in each boundary of the neighborhood nozzles segments 35 the grooves 161 and 163 of one nozzle segment 35 and the grooves 161 and 163 of the other nozzle segment 35 are communicated with each other. Also, the opposite ends of each elastic sealing member 153 are machined in parallel to the radial end surfaces 167 of the nozzle segment 35. A longitudinal length of each elastic sealing member 153 is determined so that a certain gap (t) is formed between the neighborhood sealing members 153 at normal temperature as shown in FIG. 4 and the end surfaces of the neighborhood sealing members 153 abut each other to close or substantially close the gap in a certain temperature condition to which the elastic sealing member 153 is exposed during the operation of the engine 1.

With the sealing arrangement 151 so constructed, the elastic sealing members 153 made by bending the elastic metal plates are compressively fitted in respective sealing sites, which ensures that the gaps 135 and 137 between the connectors 111 and 113, even when enlarged due to heat expansions thereof, are sealed completely or substantially completely. In particular, according to the embodiment, each elastic sealing member 153 is accommodated in the grooves 151 and 163 with its distal ends and intermediate portions abutted against the side surfaces of the grooves 169 and 173 as it is compressed radially inwardly. This ensures that the elastic sealing member 153 is held by the grooves 161 and 163 in a stable manner and, as a result, the seals are maintained in a reliable manner over a long period of time. Also, the elastic sealing members 153 are retained by the nozzle segments 35 in a stable manner so as not to displace or drop off easily due to shocks at the assembling or the contacts with the other members and, as a result, to ensure reliable seals after the assembling thereof.

The elastic sealing member 153 is positioned so that the dead-end cavity 159 is exposed to the high-pressure zone H (upstream zone), which results in that the linear portion 155 and the curved portion 159 of the elastic sealing member 153 are forced away from each other by the high-pressure in the dead-end cavity 159, causing the linear and the curved portions 155 and 157 to be forced against the associated sealing surfaces (upstream and downstream surfaces) of the flange and the opposing downstream and upstream end surfaces of the front and back walls, respectively, to establish reliable seals thereat.

Figure 5:
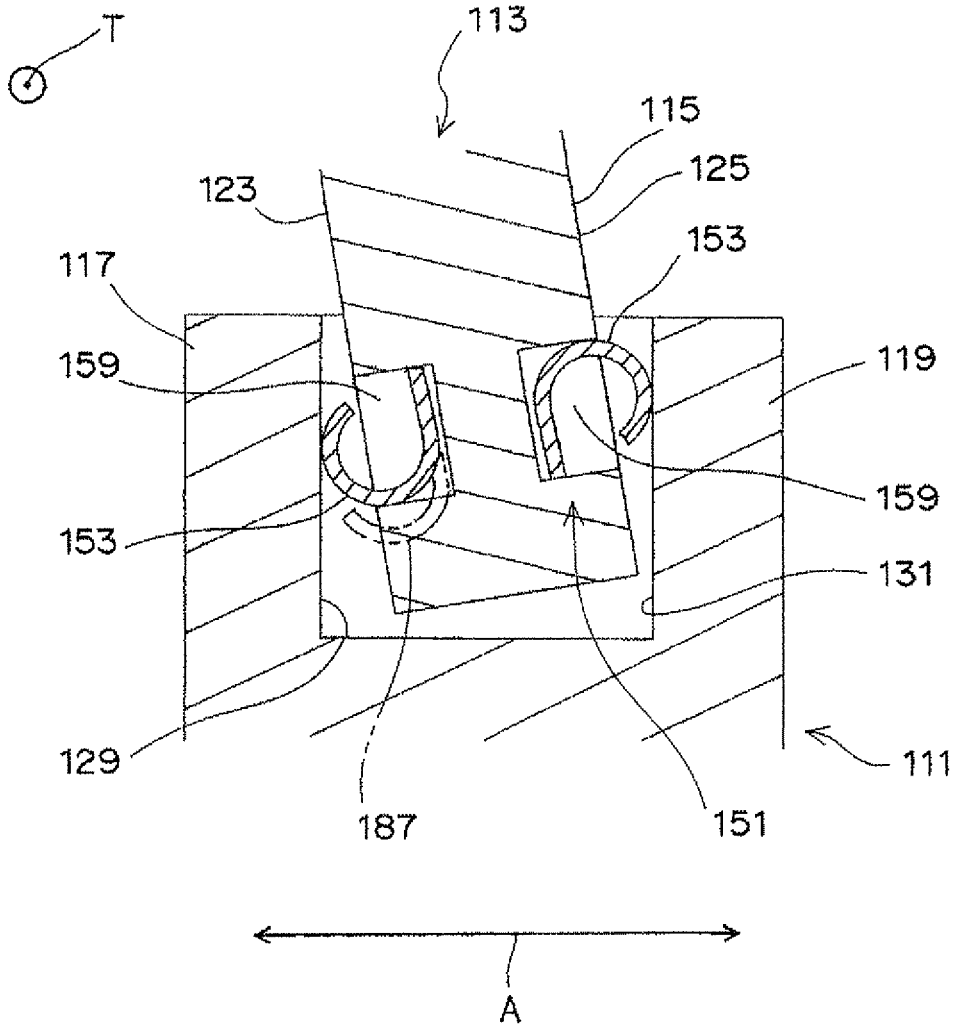
FIG. 5 is a cross sectional view showing the sealing arrangement when the nozzle segment is inclined.

Also, as shown in FIG. 4, the elastic sealing member 153 is a linear member. Then, as shown in FIG. 5, even when the outer connector 113 is inclined to the inner connector 111, the elastic sealing member 153 ensures a stable seal between the connectors. If the elastic seal member had an arcuate configuration, not the linear configuration, and the outer connector 113 were inclined toward the upstream side thereof relative to the inner connector 111, the opposite ends of the elastic seal member 187 positioned adjacent the radial end surfaces 167 of the flange (see FIG. 4) would displace away from the downstream end surface 129 of the front wall to break the associated seal. Also, a sealing arrangement with only one seal member between the connectors 111 and 113, an inclination of one connector relative to the other may break the seal, allowing the compressed air in the high-pressure zone to uselessly leak into the low-pressure zone uselessly. According to the embodiment, no such problem would occur.

Further, the sealing member which seals between the connectors 111 and 113 is divided into plural seal elements or elastic sealing member 153 (See FIG. 4). This ensures that the sealing members are incorporated in the turbine nozzle 125 without difficulty. Furthermore, according to the embodiment, the incorporated sealing elements do not displace or drop off easily, which ensures reliable seals for the assembled turbine nozzle 25.

Although several embodiments have been described above, they may be modified without departing from the gist of the invention and it should be understood that those modifications are still within the scope of the invention.

Although in the previous embodiment two elastic sealing members 153 are provided to seal the gaps 135, only one elastic sealing member may be provided.

Although the grooves are formed in the upstream and downstream end surfaces of the flange, only one groove is provided in the inner peripheral end surface 127 (see FIG. 3).

Although the groove for receiving the elastic seal has a square in cross section, it is not restrictive and another configuration such as triangular, semi-circular, or semi-ellipsoidal configuration may be used instead.

The cross section of the elastic sealing member is not limited to that described in the previous embodiment and may be a semi-circular configuration, C-like configuration, or spiral configuration extending over 360 degrees so that one end overlaps the other end.

Although the grooves 161 and 163 are formed in the flange 115 of the nozzle segment 35, at least one groove is provided in the adaptor ring 57.

Although the groove 121 is formed in the adaptor ring 57 and the flange 115 of the nozzle segment 36 is positioned in the groove 121, a groove is formed in the nozzle segment 36 and a flange is formed in the adaptor ring 57 so that the flange of the adaptor ring is positioned in the groove of nozzle segment 36 for connection thereof.

Although the seal mechanism 151 is provided only for the inner connector 110, it may be provided for the inner connector 110 or the outer connector 42 or both.

Although the sealing arrangement according to the embodiment of the invention is provided for the support structure of the first stage stationary blade of the turbine 7, it may be used for another support mechanism in another stage stationary blade.

What is claimed is:

1. A sealing arrangement for use with a mechanism, the mechanism comprising an inner annular member having a central axis and an outer annular member surrounding around the inner annular member;

a plurality of segments disposed between the inner and outer annular members and peripherally around the central axis;

an inner connecting mechanism connecting between the segments and the inner annular member; and an outer connecting mechanism connecting between the segments and the outer annular member;

wherein at least one of the inner connecting mechanism and the outer connecting mechanism includes a sealing arrangement;

the sealing arrangement comprising a pair of first seal surfaces each of which extending radially from the central axis and formed on an associated one of segments;

a pair of second seal surfaces each of which extending radially from the central axis and formed on said at least one of the annular members connected to the associated segment by an associated one of the connecting mechanisms, the second seal surfaces being positioned so that each of the second seal surfaces opposes each of the first seal surfaces;

the first seal surfaces or the second seal surfaces having respective grooves that extend linearly along respective sides of a polygon defined around the central axis; and elastic seal members fitted in the grooves to retain sealing contacts with the opposed first and second seal surfaces, wherein the respective grooves extend in a direction perpendicular to a radial axis extending from the central axis when viewed in a radial cross-section.

2. The sealing arrangement according to claim 1, wherein the elastic sealing members are compressively fitted in the grooves, wherein the grooves have a square cross-section, wherein the elastic sealing members have a J-like configuration with a linear portion and a curved portion extending from a distal end of the linear portion, the elastic sealing member being positioned in the groove so that a proximal end of the linear portion and an intermediate region of the curved portion are forced on an inner surface of the groove, and wherein the curved portion makes contact with both the inner surface of the groove and an opposed seal surface.

3. A sealing arrangement for use with a mechanism, the mechanism comprising an inner annular member having a central axis and an outer annular member surrounding around the inner annular member;

a plurality of segments disposed between the inner and outer annular members and peripherally around the central axis;

an inner connecting mechanism connecting between the segments and the inner annular member; and an outer connecting mechanism connecting between the segments and the outer annular member;

wherein at least one of the inner connecting mechanism and the outer connecting mechanism includes a sealing arrangement;

the sealing arrangement comprising a pair of first seal surfaces each of which extending radially from the central axis and formed on an associated one of segments;

a pair of second seal surfaces each of which extending radially from the central axis and formed on said at least one of the annular members connected to the associated segment by an associated one of the connecting mechanisms, the second seal surfaces being positioned so that each of the second seal surfaces opposes each of the first seal surfaces;

the first seal surfaces or the second seal surfaces having respective grooves that extend linearly along respective sides of a polygon defined around the central axis; and elastic seal members fitted in the grooves to retain sealing contacts with the opposed first and second seal surfaces, wherein the elastic sealing members are compressively fitted in the grooves, wherein the grooves have a square cross-section, wherein the elastic sealing members have a J-like configuration with a linear portion and a curved portion extending from a distal end of the linear portion, the elastic sealing member being positioned in the groove so that a proximal end of the linear portion and an intermediate region of the curved portion are forced on an inner surface of the groove, and wherein the curved portion makes contact with both the inner surface of the groove and an opposed seal surface.

4. The sealing arrangement according to claim 3, wherein the respective grooves extend in a direction perpendicular to a radial axis extending from the central axis when viewed in a radial cross-section.

* * * * *